US007089767B2

(12) United States Patent
Voth et al.

(10) Patent No.: US 7,089,767 B2
(45) Date of Patent: Aug. 15, 2006

(54) METHOD OF AND DEVICE FOR CONTINUOUS TREATMENT OF A TEXTILE PRODUCT WEB WITH STEAM FOR FIXING REACTIVE DYE ON NATURAL FIBERS

(75) Inventors: Marc-Aurel Voth, Hamburg (DE); Thorsten Behring, Seevetal (DE)

(73) Assignee: Babcock-Textilmaschinen GmbH, Seevetal (DE)

( * ) Notice: Subject to any disclaimer, the term of this patent is extended or adjusted under 35 U.S.C. 154(b) by 627 days.

(21) Appl. No.: 10/140,671

(22) Filed: May 7, 2002

(65) Prior Publication Data

US 2002/0170118 A1 Nov. 21, 2002

Related U.S. Application Data

(62) Division of application No. 09/580,261, filed on May 26, 2000, now Pat. No. 6,471,729.

(30) Foreign Application Priority Data

May 28, 1999 (DE) ..... 199 24 433

(51) Int. Cl.
*D06B 3/10* (2006.01)
*D06B 21/00* (2006.01)

(52) U.S. Cl. ..... 68/5 D; 68/5 E

(58) Field of Classification Search ..... 68/5 D, 68/5 E, 5 C; 34/541, 629, 634, 242
See application file for complete search history.

(56) References Cited

U.S. PATENT DOCUMENTS

| | | | | | |
|---|---|---|---|---|---|
| 3,685,323 | A | * | 8/1972 | Bosch et al. | 68/5 D |
| 3,686,902 | A | * | 8/1972 | Fleissner et al. | 68/5 D |
| 3,770,374 | A | * | 11/1973 | Fleissner | 8/149.3 |
| 3,835,671 | A | * | 9/1974 | Fleissner et al. | 68/5 D |
| 3,896,559 | A | * | 7/1975 | Martin | 34/662 |
| 3,949,577 | A | * | 4/1976 | Fleissner | 68/5 D |
| 4,070,877 | A | * | 1/1978 | Fleissner | 68/5 D |
| 4,362,776 | A | * | 12/1982 | Lefferts et al. | 428/222 |
| 4,718,257 | A | * | 1/1988 | Reinehr et al. | 68/5 E |
| 5,105,558 | A | * | 4/1992 | Curry | 34/449 |
| 5,428,971 | A | | 7/1995 | Beretta | 68/5 D |
| 5,855,476 | A | * | 1/1999 | Gottschalk | 432/59 |
| 6,471,729 | B1 | | 10/2002 | Voth et al. | 8/149.1 |
| 6,485,526 | B1 | | 11/2002 | Voth | 8/149.1 |
| 6,591,639 | B1 | | 7/2003 | Voth | 68/5 E |

FOREIGN PATENT DOCUMENTS

| | | |
|---|---|---|
| DE | 2 310 195 | 9/1974 |
| DE | 196 33 101 A1 | 2/1998 |
| DE | 43 03 129 C2 | 5/1998 |
| WO | 96/28604 | 9/1996 |

* cited by examiner

*Primary Examiner*—Frankie L. Stinson
*Assistant Examiner*—Joseph Perrin
(74) *Attorney, Agent, or Firm*—Michael J. Striker

(57) ABSTRACT

The arrangement for continuous treatment of a textile product with steam includes one or more treatment chambers; a transporting device having a horizontal conveyor guided through the treatment chamber or chambers; a steam-tight housing surrounding the treatment chamber or chambers; at least one circulating device with at least one circulating fan arranged in the treatment chamber or chambers and nozzle boxes arranged above and below the horizontal conveyor for delivering superheated steam to the product web conveyed on the conveyor. The horizontal conveyor is a sieve band, preferably with an opening degree amounting to from 50 to 90%. A method of steam treatment is also described.

14 Claims, 3 Drawing Sheets

METHOD OF AND DEVICE FOR CONTINUOUS TREATMENT OF A TEXTILE PRODUCT WEB WITH STEAM FOR FIXING REACTIVE DYE ON NATURAL FIBERS

CROSS-REFERENCE TO RELATED APPLICATIONS

The present application is a divisional of U.S. patent application Ser. No. 09/580,261 filed May 26, 2000, now U.S. Pat. No. 6,471,729, and the present divisional also contains subject matter in common with copending U.S. patent application Ser. No. 09/580,263, filed on May 26, 2000.

BACKGROUND OF THE INVENTION

The present invention relates to a method for continuous treatment of a textile product web with steam for fixing a reactive dye on natural fibers.

It also relates to a device for continuous treatment of textile product web of this type.

For fixing of reactive dyes on natural fibers, such as cotton or cellulose, it is known to first dry the moist product web on which the reactive dye is applied, and subsequently to fix the reactive dye on the fibers of the product web. For this purpose a promoter, for example urea, is needed and admixed to the reactive dye. The promoter holds the reactive dye in solution during dyeing and evaporates during fixing. This is true both for application of reactive dye on the product web by dyeing and also by printing.

For fixing of the reactive dye applied by printing, it is known to treat the dried product web with saturated steam. A suitable device with a steam chamber is disclosed in the patent document EP 0607 762B. For reduction of the urea consumption, this device is provided with a premoisturizing chamber.

A reduction of the urea quantity is possible, as described in the German patent document DE 43 03 129 02, in that the printed and dried product is sprayed with water immediately before its entry in the rapid festoon ager. This fixing process in the rapid festoon ager requires an average steam treatment time of 10–15 minutes. The product size generally amounts to 80–490 m, whereby a product speed of 5 to 50 in/mm results. In the rapid festoon ager the fixing of the reactive dye is performed conventionally with saturated steam at substantially atmospheric pressure, or in other words in saturated steam atmosphere. Rapid festoon ager for a product size of at least 80 meter is not efficient for smaller product sizes (smaller meter lengths).

A further appropriate steamer is disclosed in the German patent document DE 23 10 195 02. This steamer has a treatment chamber and a transporting device with at least partially horizontal product guidance by means of a conveyor. The treatment chamber is formed as a downwardly open hood. Thereby the entrained air can fall from a downwardly open steam space, so that a pure steam atmosphere is always available. Fixing of a drying product web in this steam atmosphere, in which a purely saturated steam atmosphere is also provided, is not possible without urea. The disadvantage of this steamer is that, due to the above mentioned steam treatment time of 10 to 15 min with saturated steam atmosphere in continuous operation, only small product speeds can be reached. Higher product speeds are possible only with greater structural length of the steamer with correspondingly higher investments and operation costs. The steam also is not efficiently usable when smaller quantities are to be dyed.

A further disadvantage of the above mentioned method is that the product web after application of reactive dye soluble in water is first dried and subsequently the reactive dye is fixed on the fibers. The both treatment stages of drying and fixing require two treatment devices. During pressing, conventionally for drying a pressing chamber and for fixing the above mentioned steam device are utilized.

In a special pressing method which is disclosed in the German patent document DE 196 33 101 the product web is moisturized, wet pressed and in wet condition evaporated without intermediate drying. The steaming is performed in a saturated steam atmosphere during 1.0–20 min at 96–105° C. Also, in this method during use of a reactive dye for printing of cotton, urea in conventional quantity is utilized.

A further special pressing method in which the product web is first moisturized, the wet product web is printed and subsequently an evaporation-thermosol fixation process is performed, it is disclosed in the patent document WO96/28604. The evaporation-thermosol fixation process takes place with saturated steam at temperatures of 90, 150 and 170° C. It requires a pressure-tight fixing device which conventionally is suitable only for a discontinuous operation.

SUMMARY OF THE INVENTION

Accordingly, it is an object of present invention to provide a method of continuous treatment of a textile product web with steam for fixing of a reactive dye on a product web of natural fibers which avoids the disadvantages of the prior art and which is suitable and efficient for smaller meter lengths of the product web.

In keeping with these objects and with others which will become apparent hereinafter, one feature of present invention resides, briefly stated in a method of treatment of a textile product web with steam for fixing of a reactive dye on a product web of natural fibers, which includes the steps of applying a reactive dye on a product web of natural fibers so as to form a moist product web with the reactive dye applied to it; subjecting a moist product web with the reactive dye on it to a steam treatment by bringing the moist product web with the reactive dye on it in contact with overheated water steam at a temperature of 130–230° C.; transporting the moist product web during the foregoing steam treatment at least partially horizontally through at least one treatment chamber; and blowing the hot steam into the at least one treatment chamber onto the product web by nozzle boxes arranged above and below the product web.

It is also an object of present invention to provide a device for continuous treatment of a textile product web with steam for fixing of reactive dye on natural fibers in which the inventive method can be realized.

In keeping with these objects another feature of present invention resides, briefly stated at least one treatment chamber, a transporting device having a horizontal conveyor guided through the at least one treatment chamber, a steam-tight housing which surrounds the at least one treatment chamber, the at least one treatment chamber being provided with at least one circulating device with at least one circulating fan and also with nozzle boxes arranged above and below the product web, the conveyor being formed as a sieve band.

When the method is performed and the device is designed in accordance with the present invention, the steam treatment can be performed effectively and thereby fast. Also, for fixing printed product webs are suitable.

In a method for continuous treatment of a textile product web with steam in which a moist product web of natural fibers with an applied reactive dye is brought in contact with steam, is subjected also to steam treatment, fixing treatment or dye fixing, with the steam, in accordance with the present invention in form of hot steam, or in other words overheated water steam at substantially atmospheric pressure. The hot steam is composed at least of 80 vol. %, preferably 95–100 vol. % (pure hot steam), of water steam. The hot steam has a temperature of 130–230° C. in particular of 160–230° C. In addition to the high product web temperature which with pure hot steam amounts to 100° C., the additional temperature difference between the hot steam and the product web of 30°, in particular 60° up to 130° C. makes possible an acceleration of the reaction of the reactive dye with the natural fibers. This leads, when compared with a fixing treatment in saturated atmosphere to reduced heating and fixing time, and correspondently reduced retention time in a steamed treatment device and allows therefore devices which can be used efficiently for shorter meter length.

It is important that the inventive method uses overheated water steam for steam treatment so that the moist product web is dried during the steam treatment. It has been shown that drying the product during the fixing treatment leads to an acceleration reaction of the reactive dye with the natural fibers. This results in a further reduction of the fixing time.

In the steam treatment method for many reactive dyes it is also possible to eliminate use of urea. This is true for dyes of textile product webs in which the product webs dyed with reactive dyes have a moisture content of, for example, 40–80%. This is true also for the printing of textile product webs, in which the product webs printed with reactive dye have a moisture content of, for example, 10–40%.

In a surprising manner the steam treatment methods according to the invention with enhanced drying lead to good fixing results, namely to a high color yield and a good coloring quality corresponding to the result of the prior art.

In accordance with the present invention the product web during the steam treatment is transported at least partially horizontally through at least one treatment chamber. The horizontal product web guidance makes possible a fine transportation of the moist product web with the reactive dye applied on it. In contrast to this, in a roller conveyor steamer or in a rapid festoon ager due to the vertical product web guidance there is a danger of dye running. The horizontal product web guidance, which in the case of steam treatment with a saturated steam atmosphere requires large treatment chamber structural volumes for the given product size, is practical in connection with the efficient steam treatment according to the invention with overheated steam, also for smaller meter length web products.

In accordance with the present invention, the overheated steam is blown onto the product web by nozzle boxes arranged above and below the product transport path in the treatment chamber. Preferably, the hot steam is guided in a circulating process. In contrast to the use of saturated steam atmosphere disclosed in the German patent document DE 23 10 195 02 without significant flow speed, the product web is blasted with overheated water steam. The blasting makes possible a higher exchange rate of the treatment steam on the outer surface of the product web and thereby a stronger energy supply per time than in a stationary steam atmosphere. By the blasting, the steam treatment is more efficient. The inventive steam treatment method is useful and improved for small meter length.

The utilization of overheated steam when compared with saturated steam during circulation through a circulating system has the advantage of a lower danger of condensation in the circulating system. With the use of the inventive method for printing of textile product webs, the moisture content of the printed product web before the steam treatment is adjusted to 10–40%, in particular 15–25%, and the product web is dried during the steam treatment to the residual moisture content of 1–10%, in particular 3–7%. In surprising manner, it has been determined that with the inventive method for a printed product web, optimal fixing results can be obtained with a residual moisture content of the product web smaller than the equilibrium moisture content. The equilibrium moisture content amounts, under normal conditions, to substantially 10% moisture, based on the weight of the product web, for cellulose and substantially 8% moisture for cotton. Regulation of the residual moisture content of the product web in the treatment chambers is not necessary.

The retention time of the product web in the treatment chamber can be 35–60 seconds, preferably 10–20 seconds. This retention time is sufficient for drying and for complete fixing with a good dye yield. It makes it possible to provide a treatment plant with comparatively small structural dimensions.

By the transportation of the product web by means of a sieve band, on the one hand a transportation of the product web through the treatment chamber can be performed without contact with the printed surfaces, and on the other hand a steam supply from above and from below on the product web is possible.

An arrangement for continuous treatment is also provided in accordance with the present invention. Since it has a steam-tight housing which surrounds all treatment chambers, the use of heat steam is possible. By means of the circulating devices with at least one circulating fan and nozzle boxes arranged above and below the product web, the steam treatment with hot steam is effective also with the fine, horizontal product web guidance.

The arrangement in accordance with the present invention is especially suitable for fixing of small meter lengths.

The transportation of the product web by a conveyor formed as a sieve band makes possible, with a contact-free transportation of the printed circuit of the product web, a steam supplied from above and below onto the product web. The device is therefore especially suitable for dye fixing of the printed product webs.

A great opening degree of the sieve band makes possible a great contact surface of the product web for hot steam. This leads to a high exchange rate and thereby to an efficient steam treatment. The deviating rollers for the conveyor formed as the sieve band arranged above the steam-tight housing simplified the construction of the arrangement. However, slots must be provided for entry and exit of the conveyor.

A return guidance of the conveyor under the housing requires only an inlet slot and an outlet slot for the conveyor and makes possible an arrangement of a tensioning system and a drive for the conveyor outside of the steam-tight housing. This simplifies the construction of the arrangement. A guiding band can extend at an acute angle to a vertical through the inlet lock. It can be formed by the conveyor itself or a further band. It allows deviations of the product web by an angle of greater than 90°. Thereby the danger of negatively affecting the printing image by excessive deviations of the product web, such as in the case of a deviation around 90°, is reduced. The acute angle amounts to approximately 30–60°.

A supply band which extends in the vicinity of the conveyor running through the treatment chambers simplifies the supply of the starting portion of a new product web to the conveyor.

A supply band which extends through the inlet lock is especially suitable for devices with a conveyor running back through the treatment chamber.

In accordance with a further feature of present invention, locks are arranged before and after the housing. The locks extend from the bottom to over the transporting plane of the product web and are subdivided into a lower, downwardly open prechamber and a main chamber arranged over it. Suction passages or suction boxes can be connected with the prechamber. When compared with the known inlet and outlet slots with the suction boxes disclosed in the German patent document DE-A 195 46 344, due to the separate locks with the prechamber and aspiration device, the penetration of air and thereby condensation of steam to water is reliably prevented. A lock which is known from the German patent document DE 198 58 339, in which before the inlet slot of the housing steam is blown onto the product web, is less suitable for fixing of dye because of the danger of dye running.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
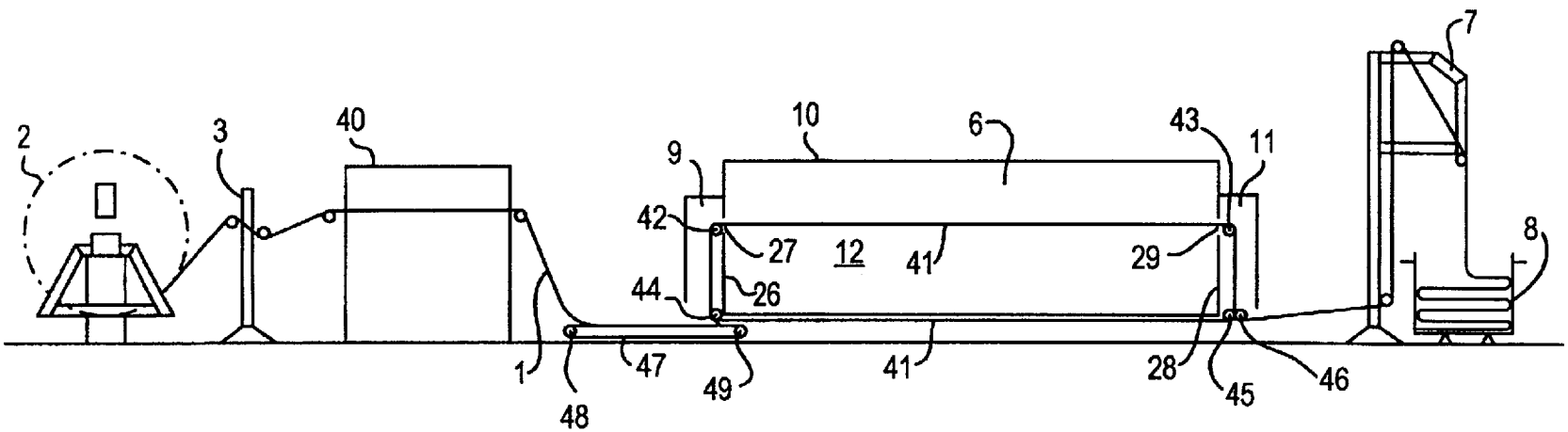
FIG. 1 is a view showing a device for printing a textile product web with an inventive arrangement for dye fixing in accordance with a first embodiment of the present invention.
Figure 2:
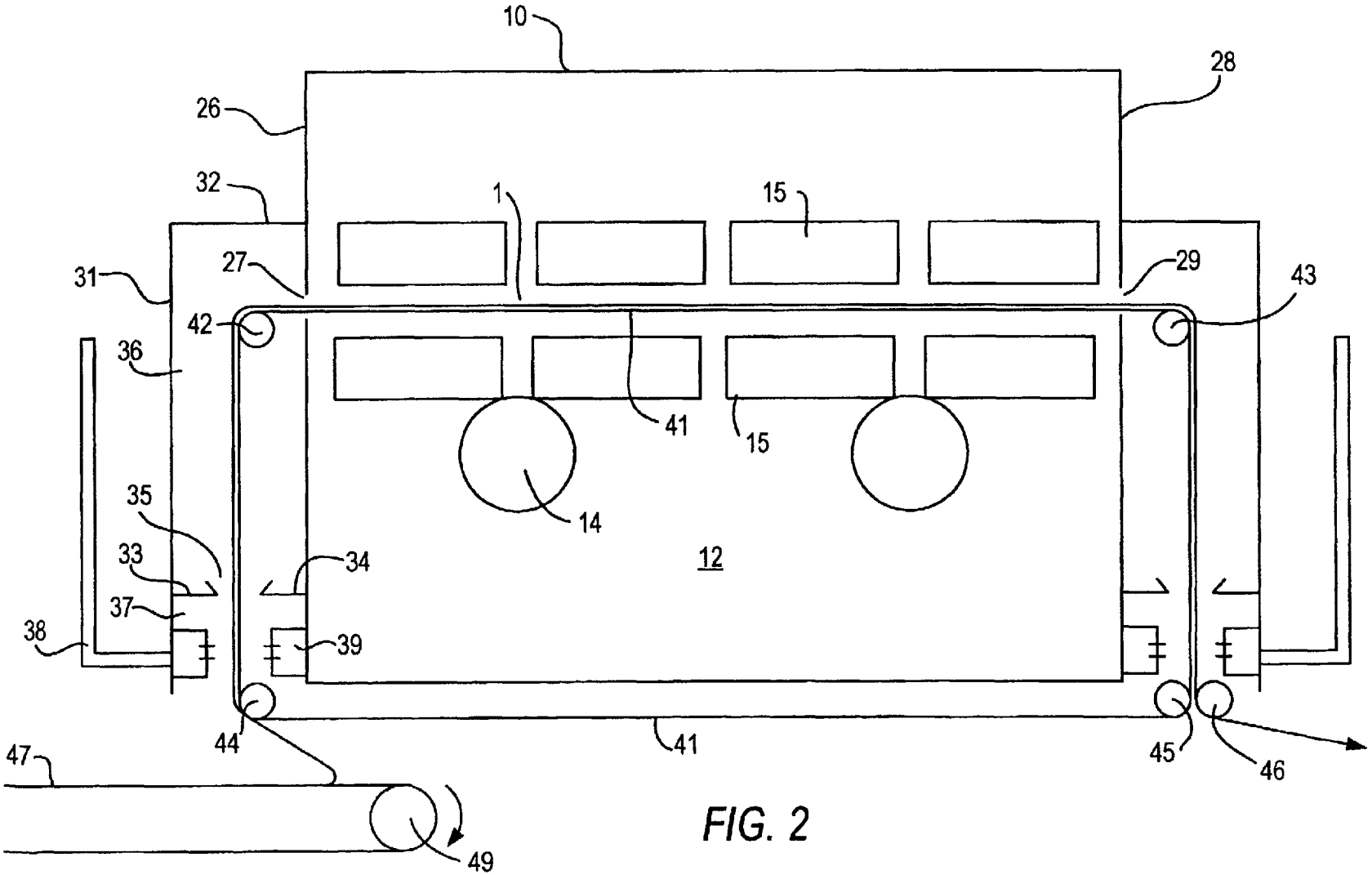
FIG. 2 is a view showing this arrangement with a schematic cross-section.

A device for printing of a textile product web 1 of natural fibers, for example of cotton or cellulose, with reactive dye has units which are arranged one after the other in a transporting direction and include a product storage 2, a supply device 3, a printing device 40, a device for dye fixing 6, a further supply device 7, and a further product storage 8. In this example the front product storage 2 is formed as a winder, the front supply device 3 is formed as a boom, the rear supply device 7 is formed as a taking off table and rear product storage 8 is formed as a container. The printing device 40 is formed as a rotary printing press. Alternatively also another printing press can be used such as for example a flat bed printing machine or an ink-jet printing machine.

The device 6 for dye fixing has an inlet lock 9, a steam-tight heat insulating housing 10, and an outlet lock 11. The housing 10 includes one or several, preferably one to four, modular treatment chambers 12 arranged in a row. The interior of the housing 10 is subdivided by the treatment chambers 12 into one or several successive fields. The housing 10 is not subdivided and embraces all treatment chambers, in this example a treatment chamber 12.

A circulating device is provided in each treatment chamber 12. It is a device for guiding hot steam in a circulation, known as a circulating process with at least one circulating fan 14, at least one heating device which is not shown in the drawings and a nozzle box 15 with nozzle openings directed toward the product web 1. The nozzle boxes 16 are arranged above and below the product web 1 and extend transversely over the product level 1. In a treatment chamber 12, one or several upper and lower nozzle boxes 15 can be arranged one after the other. In this example the treatment chamber 12 is provided with four nozzle boxes 15 arranged above and four nozzle boxes arranged below and with two circulating fans 14. Each of the circulating fans 14 is associated with two upper and two lower nozzle boxes 15. The upper and lower nozzle boxes 15 can be arranged so that they are offset opposite to or relative to one another. The nozzle openings of the nozzle boxes 15 are preferably formed as slots.

The transporting device has a rotating conveyor which is formed as a sieve band 41. It is guided by two upper deviating rollers 42, 43 with its upper run through the treatment chamber 12 and by two lower deviating rollers 44, 45 with its lower run through the treatment chamber 12 and underneath the housing 10. The upper front deviating roller 42 is located completely in the inlet lock 9 and the upper rear deviating roller 43 is located completely in the outer lock 11. Their arrangement is such that, the product web 1 is guided in the treatment chamber 12 flat and horizontal, or in other words in a horizontal transporting plane. One of the lower deviating rollers 44, 45 is connected with a not shown drive.

The transporting device also has a not shown, conventional tensioning device, with which the sieve band 41 is tensioned, as well as not shown supporting devices in the treatment chamber 12. The supporting devices can be formed by a longitudinal slide arranged at the sides on the nozzle boxes 15 or by supporting rollers arranged between the nozzle boxes 15.

The sieve band 41 has an open surface over at least 50% to maximum 90%. It is composed in this example of a metal link conveyor with an open surface over 80% and has on its sides chain links. Correspondingly, the deviating rollers 43, 44, 45 and 46 are provided on its sides with toothed gears. Alternatively, the sieve band 41 can be formed as perforated metal band or as a glass fabric band. The housing 10 has an inlet slot 27 in a front wall 26 and an outlet slot 29 in a rear wall 28. The product web 1 can be introduced into the housing 10 and withdrawn from it through the inlet slot 27 and the outlet slot 29 correspondingly.

The inlet lock 9 has a front plate 31 which extends parallel to the front wall 26 in the vicinity of a lower edge 30 to above the inlet slot 27, a cover plate 32 and two not shown side plates. The plates 31, 32 of the inlet slot 9 are connected steam-tightly with one another and with the front wall 26. The inlet lock 9 is extended by the intermediate plates 33, 34 which extend from the front plate 31 and from the front wall 26 into the interior of the inlet lock 9. A gap 35 is maintained between them for the product web 1 and in some cases a conveyor, so that it is subdivided into an upper main chamber 36 and a lower pre-chamber 37. The pre-chamber 37 is open downwardly. A suction device, in this case a suction passage 38 connected with a not shown fan, is connected to the pre-chamber 37. In some cases, a as in the shown example, a suction box 39 is provided in the pre-chamber 37 to which the suction passage 38 is connected. The deviating roller 44 of the transporting device is located directly under the pre-chamber 37 and the deviating roller 42 is located before the inlet slot 27.

The outlet lock 11 is formed analogously as the inlet lock 9. The deviating rollers 43, 45 are arranged analogously to those of the inlet lock 9. The transporting device also has a guiding roller 46 which is arranged behind the deviating roller 45 for deviation of the product web 1 and for separation from the sieve band 41, and a supply band 47 for supplying the product web 1 to the device 6. The supply band 47 which is guided over the rollers 48, 49 runs in this example horizontally and extends to underneath of the pre-chamber 37 of the inlet lock 9.

For printing, the product web 1 is pulled from the product storage 2 over the supply device 3 formed as boom and through the printing device 40 formed as a rotary printing press to the device 6 for dye fixing.

The product web 1 is transported over the supply band 47 of the transporting device to the under the pre-chamber 37 of the inlet lock 9. Their the sieve band 41 takes over the transportation from below to the pre-chamber 37, through the gap 35 into the main chamber 37, around the deviating roller 42, through the inlet slot 37 and through the treatment chamber 12. For this purpose the product web 1, for example automatically is clamped on the sieve band. The product web 1 leaves the device 6 through the outlet slot 29 and the outlet lock 11. It is supplied over the supply device 7 which is formed as a taking off table to the product storage A which is formed as a container. The product web speed amounts for example from 40 m/min.

In the printing device 40 the product web 1 is provided with printing paste. The moist product web 1 during its transportation flatly through the treatment chamber 12 of the device 6 is acted upon by hot steam from the nozzle boxes 15 arranged above and below the product web 1 and having nozzle openings oriented toward the product web. The nozzle pressure amounts to 200–1000 PA and a thermal transmission power is substantially 240 W/m$^2$.

The temperature of the hot steam amounts to 130° in particular 160° to 230° C., and the retention time of the product web 1 in the treatment chamber 12 amounts to 5–60 seconds, preferably 10–20 seconds. The residual moisture of the product web 1 when it leaves the housing 10 amounts during printing to less than the equilibrium moisture under normal conditions, or in other words it is smaller than 10%.

In the treatment chamber 12 and in the main chamber 36 the inlet and outlet locks 10, 11 are maintained with a slight overpressure. The steam content, preferably between 95 and 100 vol. percent, is maintained by changing of the quantity of the aspirated hot steam, through the suction passages 38 of the pre-chambers 37 of the input and outlet locks 9, 11. A regulation of a predetermined residual moisture of the product web 1 is not needed.

Figure 3:
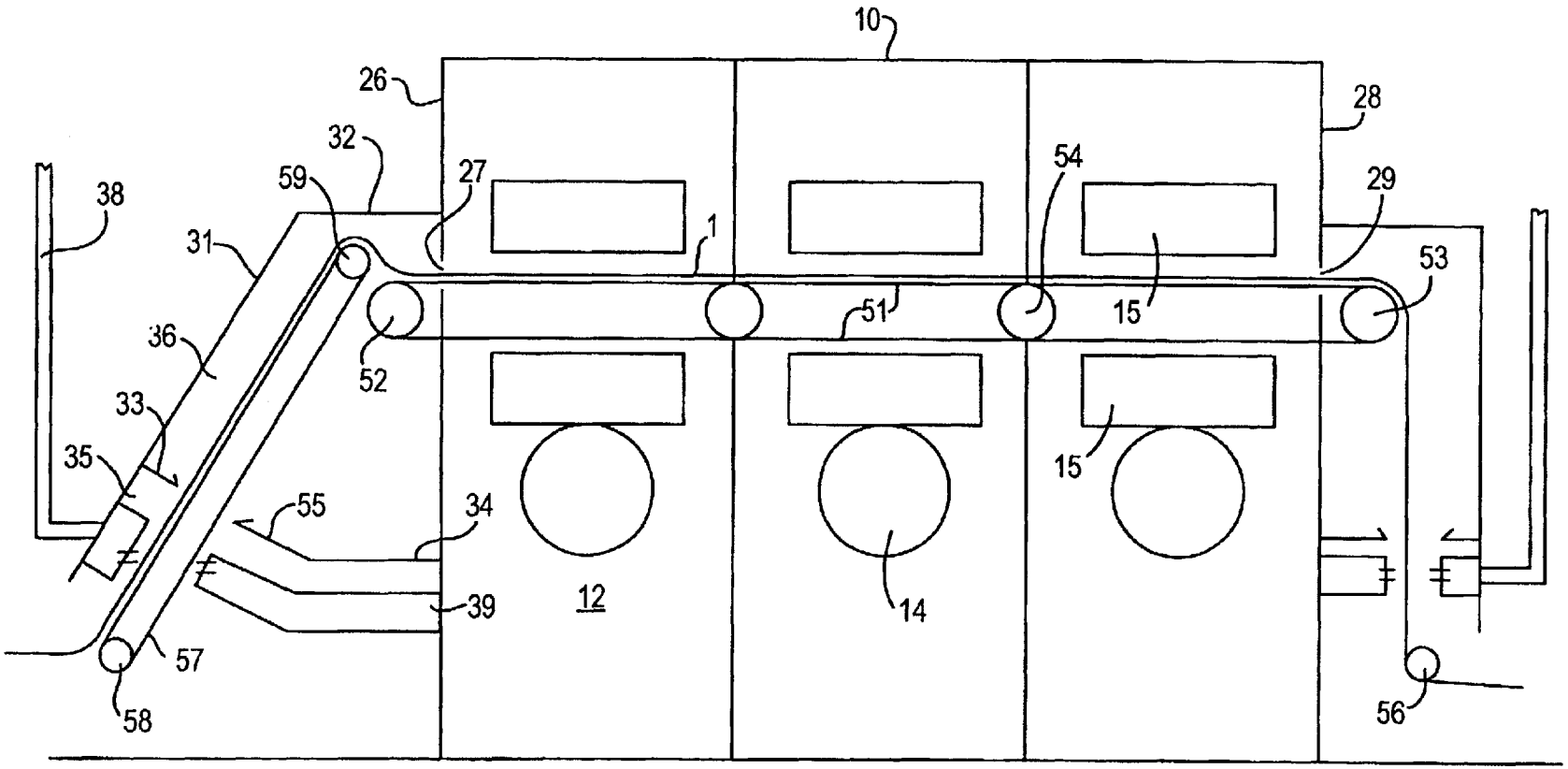
FIG. 3 shows an inventive arrangement for dye fixing in accordance with a second embodiment of the present invention also with a schematic cross-section.

In an example of the printing process, a product web 1 of cotton with applied printing paste as reactive dye without urea with a product web weight 80 g/m$^2$ is transported with a product web speed of 40 m/man through the device 6. The temperature of the pure hot steam amounts to 100° C. The nozzle pressure at the nozzle openings of the nozzle boxes 15 amounts to 700 PA. After a retention time of 5 seconds the overwhelming part of the dye is reacted with the fibers of the product web 1 and is fixed. After further 5 seconds, the product web 1 is completely dried and the residual part of the dye is fixed. The initial moisture is reduced by approximately 20% in the device 6 to a value smaller or substantially equal to 5%. The total retention time in the device 6 amounts to 10 seconds. In the embodiment shown in FIG. 3, the device 6 for dye fixing corresponds to the previously described device. Three treatment chambers 12 are arranged in the housing 10. Each treatment chamber 12 is provided with a circulating fan 14 and an upper and a lower nozzle cast 15.

The transporting device also has a circulating conveyor formed as a sieve band 51, which in contrast to the first example is guided over two deviating rollers 52 and 53 with its upper and with its lower run through the treatment chambers 12. In other words the conveyor is supplied back through the treatment chambers 12. Also the deviating roller 52 is located completely in the inlet lock 9 and the deviating roller 53 is located completely in the outlet lock 11. Their arrangement is such that the product web 1 is guided in a horizontal transporting plane. The deviating roller 53 in the output lock 11 is connected with a not shown drive. In the outlet lock 11 a not shown tensioning device for the conveyor is located.

The transporting device is also provided with transporting rollers 54 in the field abutments, or in other words in the regions in which the treatment chambers 12 abut against one another.

The input lock 9 of this device 6 for dye fixing extends at an acute angle to a vertical. For this purpose the front plate 31 is arranged at this acute angle to the vertical and the not shown side plates are correspondingly shaped. The intermediate plate 34 extending from the front wall 26 is extended in correspondence with the deviation of the plate 31 and has at least front end such an edge 55 that it ends opposite to the intermediate plate 33 extending from the front plate 31. Also, the nozzle box 39 extending from the front wall 26 is correspondingly elongated and edged.

The transporting device has in this example a guiding roller 56 at the outlet of the outlet lock 11 and a supply band 57. The supply band 57 is guided over two rollers 58, 59, extends parallel to the front plane 31 and extends through the front chamber 37 and the main chamber 36 of the inlet lock 9. In other words the supply band 57 forms a guiding band which runs at an acute angle to the vertical through the inlet slot 9. The gap 35 between the intermediate plates 33, 34 and the distance between the suction boxes 39 is formed correspondingly wide. The upper roller 59 of the supply band 58 is arranged substantially before and substantially above the deviating roller 52 and the roller 56 before the pre-chamber of the input lock 9.

During printing, the moist product web 1 provided with the printing paste is transported over the supply band 57 through the inlet lock 9, placed on the sieve band 51 from above and transported on the sieve band 51 through the treatment chambers 12 to the outlet lock 11. From the outlet lock 11, the product web 1 is withdrawn over the guiding roller 57.

It will be understood that each of the elements described above, or two or more together, may also find a useful application in other types of constructions differing from the types described above.

While the invention has been illustrated and described as embodied in METHOD OF AND DEVICE FOR CONTINUOUS TREATMENT OF A TEXTILE PRODUCT WEB WITH STEAM FOR FIXING REACTIVE DYE ON NATURAL FIBERS, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An arrangement for continuous treatment of a textile product web with steam, comprising:

at least one treatment chamber;

a steam-tight housing which surrounds said at least one treatment chamber;

an inlet lock and an outlet lock arranged before and after the housing; a transporting device for transporting the textile product web through said at least one treatment chamber, said inlet lock, and said outlet lock, said transporting device comprising a horizontal conveyor, said horizontal conveyor transporting the textile product web through said at least one treatment chamber;

said at least one treatment chamber being provided with at least one circulating device with at least one circulating fan and also with nozzle boxes for delivering hot steam arranged above and below the horizontal conveyor for the product web, said horizontal conveyor being formed as a sieve band with an opening degree of from 50 to 90%.

2. An arrangement as defined in claim 1, wherein said horizontal conveyor comprises two deviating rollers located outside of said housing, at least one of said deviating rollers being arranged completely in at least one of said inlet lock and said outlet lock.

3. An arrangement as defined in claim 1, wherein said horizontal conveyor has two upper deviating rollers and two lower deviating rollers located outside of said housing, said conveyor being guided by said two upper deviating rollers through said at least one treatment chamber of said housing and by said two lower deviating rollers underneath of said housing.

4. An arrangement as defined in claim 1, wherein said transporting device has a guiding band which extends at an acute angle to a vertical said guiding band extending through said inlet lock.

5. An arrangement as defined in claim 1, and further comprising a supply band which extends in front of said housing in a vicinity of said conveyor.

6. An arrangement as defined in claim 5, wherein said conveyor is guided back through said at least one treatment chamber, said supply band extending through said inlet lock.

7. An arrangement as defined in claim 1, wherein said inlet lock, which extends from near a bottom to over a transporting plane of the product web, opens downwardly in a lower region thereof and is provided with suction devices; and the outlet lock is formed substantially the same as said inlet lock, and wherein said inlet lock and said outlet lock are subdivided each into a main chamber and a lower pre-chamber, said lower pre-chamber being arranged near the bottom and connected with the suction devices.

8. An apparatus for printing a textile product with a reactive dye, said apparatus comprising:

a printing device for applying a reactive dye to a textile product web;

a textile product supply device for supplying the textile product web to the printing device; and a device for fixing said reactive dye on said textile product web, said device for fixing being arranged following said printing device to receive said textile product web with said reactive dye applied thereon;

wherein said device for fixing said reactive dye comprises at least one treatment chamber, a steam-tight housing which surrounds said at least one treatment chamber, an inlet lock and an outlet lock arranged before and after the housing, a transporting device for transporting the textile product web through said at least one treatment chamber, said inlet lock, and said outlet lock, said transporting device comprising a horizontal conveyor, said horizontal conveyor transport the textile product web through said at least one treatment chamber in a horizontal transporting plane;

and wherein said at least one treatment chamber includes at least one circulating device and nozzle boxes arranged above and below the horizontal conveyor for the textile product web for delivering hot steam to said textile product web from above and below in order to fix said reactive dye on said textile product web and to dry said textile product web; and wherein said horizontal conveyor comprises a sieve band with an opening degree of from 50 to 90%.

9. The apparatus as defined in claim 8, wherein said inlet lock and said outlet lock comprises means for preventing admission of air and thus steam condensation, and said horizontal conveyor comprises two deviating rollers located outside of said steam-tight housing and at least one of said two deviating rollers is arranged completely within at least one of said inlet lock and said outlet lock.

10. The apparatus as defined in claim 8, wherein said inlet lock and said outlet lock comprises means for preventing admission of air and thus steam condensation, and said horizontal conveyor comprises two upper deviating rollers arranged completely within said inlet lock and said outlet lock respectively and two lower deviating rollers arranged underneath of said steam-tight housing and outside of said inlet lock and said outlet lock.

11. The apparatus as defined in claim 8, wherein said inlet lock and said outlet lock comprises means for preventing admission of air and thus steam condensation, and said transporting device has a guiding band for transporting said textile product web through said inlet lock and said guiding band extends at an acute angle to a vertical direction.

12. The apparatus as defined in claim 8, further comprising a supply band for receiving said textile product web with the reactive dye from the printing device and for delivering said product web to said device for fixing said reactive dye on said textile product web, and wherein said supply band extends in front of said steam-tight housing to the vicinity of said horizontal conveyor.

13. The apparatus as defined in claim 12, wherein said inlet lock and said outlet lock comprises means for preventing admission of air and thus steam condensation, and wherein said supply band extends through said inlet lock and said horizontal conveyor is guided back through said at least one treatment chamber.

14. The apparatus as defined in claim 8, wherein said inlet lock and said outlet lock comprises means for preventing admission of air and thus steam condensation, and wherein said inlet lock extends from near a bottom to above a transporting plane of the textile product web on said horizontal conveyor and is open in a lower region downwardly and provided with suction devices; and said outlet lock is formed in substantially the same manner as said inlet lock and both said inlet lock and said outlet lock are divided into a main upper chamber and a lower pre-chamber arranged near a bottom and connected with said suction devices.

* * * * *